United States Patent [19]

Hoyt, Jr. et al.

[11] 4,076,560

[45] Feb. 28, 1978

[54] WROUGHT COPPER-SILICON BASED ALLOYS WITH ENHANCED ELASTICITY AND METHOD OF PRODUCING SAME

[75] Inventors: Joseph B. Hoyt, Jr., Bethany; Eugene Shapiro, Hamden, both of Conn.

[73] Assignee: Olin Corporation, New Haven, Conn.

[21] Appl. No.: 666,879

[22] Filed: Mar. 15, 1976

[51] Int. Cl.[2] ..... C22C 9/10

[52] U.S. Cl. ..... 148/11.5 C; 75/157.5; 75/160; 75/164; 148/32; 148/160

[58] Field of Search ..... 75/157.5, 160, 162, 75/164; 148/11.5 C, 12.7 C, 160, 32, 32.5

[56] References Cited

U.S. PATENT DOCUMENTS

| | | | |
|---|---|---|---|
| 1,729,208 | 9/1929 | Corson | 148/12.7 C |
| 3,475,227 | 10/1969 | Caule et al. | 148/11.5 C X |
| 3,551,214 | 12/1970 | Ford et al. | 75/160 X |
| 3,694,273 | 9/1972 | Crane et al. | 75/160 X |
| 3,841,921 | 10/1974 | Shapiro et al. | 148/12.7 C X |

OTHER PUBLICATIONS

Merit in Copper-Silicon Alloys, reprinted from the Iron Age of Feb. 3, 1927, Corson, 4 pages.

*Primary Examiner*—L. Dewayne Rutledge
*Assistant Examiner*—Michael L. Lewis
*Attorney, Agent, or Firm*—Robert A. Dawson; Robert H. Bachman

[57] ABSTRACT

Copper-silicon based alloys which exhibit high elastic properties and resistance to bending fatigue are disclosed. These alloys incorporate silicon in amounts ranging from 4.4 to 5.2%. Optional elements may be added to the copper-silicon alloys, but are limited in amounts such that not less than 4.4% of silicon is present in the alloy. These alloys have particular utility in spring-type electrical connection devices.

9 Claims, No Drawings

WROUGHT COPPER-SILICON BASED ALLOYS WITH ENHANCED ELASTICITY AND METHOD OF PRODUCING SAME

BACKGROUND OF THE INVENTION

The present invention relates to copper base alloys which exhibit elastic properties for use in electrical contacts, springs, etc. These formed shapes made from these alloys withstand a large number of flexing cycles without fracture and exhibit enhanced elasticity. These copper base alloys are also utilized to provide devices exhibiting good electrical conductivity as well as non-magnetic and corrosion resistant properties.

Certain materials exhibit a very high degree of elasticity but are unacceptable for such applications as electrical connecting devices. One example of such an elastic material is rubber, which because of its inability to effectively conduct electricity and relative inability to resist heat, does not exhibit desirable properties for electrical connector applications. Therefore, the prior art has concerned itself with metals which exhibit some degree of the elasticity of rubber without its disadvantages.

Certain copper-zinc and copper-aluminum based alloy systems have been utilized in electrical connector applications because they exhibit a degree of elasticity along with fair electrical conductivity and other physical properties. The problem with these alloys is that they are very difficult to fabricate and process, thus making their commercial significance as sheet products fairly small.

Because of these problems with prior art materials, a new alloy is required for such applications as electrical connectors. This alloy or this family of alloys should exhibit high elasticity, good electrical conductivity and high mechanical properties without being difficult to fabricate.

SUMMARY OF THE INVENTION

The present invention comprises a copper base alloy useful in such applications as electrical connectors, which exhibits a high degree of elasticity, good electrical conductivity and high physical properties without being overly difficult to produce or fabricate. This alloy specifically contains silicon as the main alloying ingredient with optional amounts of other elements as follows (in terms of weight percent): 0.1 to 3.0% zinc, 0.1 to 1.0% each of aluminum, gallium, germanium or indium, 0.1 to 2.0% total of cobalt and/or iron, and 0.05 to a total of 0.6% titanium, zirconium and chromium. This alloy system provides a fabricated product with a very high fatigue strength as well as a good electrical conductivity.

Accordingly, it is a principal object of the present invention to provide an alloy system which exhibits a high degree of elasticity as well as good electrical conductivity and physical property values.

It is a further object of the present invention to provide an alloy system which exhibits a high degree of elasticity but which is not difficult to fabricate and process.

Further objects and advantages of the present invention will appear hereinbelow.

DETAILED DESCRIPTION

The stress-strain behavior of metallic materials is characterized by an initial linearly elastic region (Hookian elastic) of limited duration followed by conventional plastic flow. Upon unloading from the linear elastic region, no permanent strain remains in the tested metallic sample. However, unloading from the plastic region results in a permanent set in the metallic sample. The magnitude of this permanent set is given by the difference between the total strain imposed on the testing sample and the elastic strain, where the elastic strain equals the applied stress divided by the Young's modulus value.

In contrast to metallic stress-strain behavior, rubber and rubber-like materials exhibit an extended non-linear elasticity. This elasticity is evident where deviations from linear stress-strain behavior are entirely elastic and there is no permanent strain exhibited upon unloading in the tested sample.

This high degree of elasticity is desirable where large deflections without a permanent set are desired in an application. This situation is usually encountered in fatigue and spring contact applications. One example of an application where elasticity is desirable is where an electrical plug is inserted in the jaws or prongs of a bent spring type electrical contact. The jaws or prongs are forced apart upon this insertion and upon removal of the plug, it is desirable to have the jaws or prongs of the contact return to their original position and exhibit no permanent deformation. This return to original position without appreciable permanent deformation is very easily obtained by rubber-like materials which withstand large deflections without a permanent set. This requirement, however, becomes a restriction for metallic materials where large deflections do cause permanent plastic deformation in shapes made from such material.

While the rubber-like materials exhibit the desired high degree of elasticity, such materials do not possess either the electrical conductivity or heat-resisting properties which are desirable in electrical connectors. Therefore, such materials cannot be used in such applications. It becomes necessary to determine which metals may be utilized in such electrical connector applications so that desired conductivity and physical property values are maintained while resistance to permanent deformation is also achieved in the connector.

This invention relates to copper-silicon based alloys which exhibit a rubber-like elastic behavior which is generally termed "superelasticity", but which also possess adequate ductility to be processed and fabricated. These alloys do not rely upon what is conventionally termed a martensite transformation to achieve this degree of elasticity. This superelastic behavior is obtained by a stress induced reversible phase transformation in the alloy from an FCC alpha phase to a HCP kappa phase which occurs over critical ranges of composition within the copper-silicon based alloy system.

The copper base alloys of the present invention contain silicon as the main alloying ingredient. Silicon is added in amounts ranging from 4.4 to 5.2%. Optional elements which may be used in substituting for silicon, provided that not less than 4.4% of silicon is present in the alloy, include 0.1 to 1.0% each of aluminum, gallium, germanium or indium. Zinc may be optionally added in amounts ranging from 0.1 to 3.0%. Elements which may be added to the alloy as grain refiners include titanium, zirconium and chromium, from 0.05 to a total for the three elements of 0.6%. Cobalt may also be added as a grain refiner, either by itself, in combination with iron or it may be fully replaced by iron. The cobalt and iron additions are made in the alloy from 0.1 to a total for the elements of 2.0%.

The processing of the alloys of the present invention apparently is dependent upon the particular alloying ingredients added to the copper-silicon alloy. Processing generally includes casting the alloy, hot rolling the cast ingot at temperatures from 650° to 900° C, and optionally homogenizing the ingot either before or after the hot rolling step in the same temperature range noted for hot rolling. After cleaning the surface of the rolled ingot, the processing continues using cycles of cold rolling and annealing to obtain the desired final gage. The annealing temperature employed may range from 500° to 900° C. For best properties, the last anneal should be at 500° to 760° C and preferably 500° to 600° C.

Both hot and cold rollability of the alloys is dependent upon the composition of the alloy. For binary copper-silicon alloys, as the silicon content decreases, fabricability of the ingot increases. The alloy may be cold rolled to a 30% reduction with silicon contents up to about 5.2% and may be cold rolled to a 40–50% reduction, which is preferred, with silicon contents of 4.4–4.9%.

The present invention will be more readily apparent from a consideration of the following illustrative examples.

EXAMPLE I

The alloys of Table I were cast in air as 10 lb. ingots by the Durville casting method. The ingots were hot rolled starting the temperatures ranging from 750° C to 850° C. Care was taken not to lose heat during the hot rolling step. The ingots were homogenized either before or after hot rolling at temperatures ranging from 750° to 850° C. The hot rolled alloy strip was then surface cleaned and subjected to cycles of cold rolling and annealing to obtain the desired final gage. The annealing temperature employed in this series of steps ranged from 550° to 850° C.

TABLE I

Analyzed Compositions of Experimental Alloys Weight Percent Addition

| Alloy | Si | Co |
|---|---|---|
| A | 5.08 | — |
| B | 4.85 | — |
| C | 4.78 | — |
| D | 4.44 | — |
| E | 5.14 | — |
| F | 5.10 | 0.20 |
| G | 4.80 | 1.00 |
| H | 4.80 | — |
| X | 3.35 | — |

EXAMPLE II

Alloy D was annealed at 575° C to obtain properties of 70.0 ksi ultimate tensile strength, 30 ksi 0.2% offset yield strength and 48% elongation. The alloy was examined for superelasticity properties by loading a sample to various strains, unloading the sample and comparing the amount of elastic recovery experimentally observed to the amount of elastic recovery calculated from Hookian elasticity. The calculated Hookian elasticity is obtained by taking the value of stress under load and dividing that by Young's modulus. The Young's modulus value for Alloy D was assumed to be $16 \times 10^6$ psi. The results of two such elastic recovery comparison experiments on separate samples of Alloy D are given in Table II.

TABLE II

Comparison Of Observed And Calculated Elastic Recovery In A Cu-4.44% Si Alloy

| Strain Under Load, % | Stress ksi | Strain Load Removed, % | Elastic Strain Recovered, % | Calculated Elastic Strain, % |
|---|---|---|---|---|
| Test Run #1 | | | | |
| 7.5 | 48 | 6.2 | 1.3 | 0.30 |
| 15.0 | 59 | 13.5 | 1.5 | 0.36 |
| 27.0 | 67 | 25.2 | 1.8 | 0.42 |
| Test Run #2 | | | | |
| 5.0 | 45.5 | 4.0 | 1.0 | 0.28 |
| 15.0 | 57.2 | 13.7 | 1.3 | 0.35 |
| 25.0 | 64.2 | 23.0 | 2.0 | 0.40 |

Table II shows that alloys of this composition recover far more elastic strain than would be predicted by Hookian elasticity. This ability to recover more strain elasticity than predicited is termed superelasticity. This is a very desirable attribute for electrical spring contact devices. This property is most likely due to a reversible stress induced phase transformation between FCC alpha phase and HCP kappa phase in the Cu-Si system.

EXAMPLE III

A comparison of total deflection under loading with deflection after loading is removed was made between annealed material containing 3.35% Si (Alloy X) and 4.80% Si (Alloy H). Two annealing temperatures were used, 575° C and 760° C. The comparison is shown in Table III.

TABLE III

Comparison Of Total Strain Under Loading With Strain Remaining After Loading Is Removed

| Alloy, Annealing Temperature | Strain Under Load, % | Strain Load Removed, % |
|---|---|---|
| X, 575° C | 0.50 | 0.42 |
| X, 760° C | 0.31 | 0.26 |
| H, 575° C | 0.50 | 0.10 |
| H, 760° C | 0.37 | 0.14 |

Table III shows that copper base alloys containing 4.80% silicon exhibit an elastic response with the greatest percentage of deflection under load recovered when the load is removed, while the alloy containing 3.35% silicon shows a normal elastic behavior. In addition, there is a dependence upon annealing temperature for the superelastic 4.80% Si alloy. The 575° C annealing temperature provides more effective superelasticity than the 760° C annealing temperature. This is most likely due to the proximity of the alloy composition-temperature combination to the alpha/alpha-kappa phase boundary of the equilibrium phase diagram of this alloy. The closer the composition-temperature combination is to this boundary, the more the reversible stress induced transformation from alpha to kappa is enhanced. It is also believed that the transformation is grain boundary nucleated and that lower annealing temperatures, which provide finer grain sizes, thus promote the transformation. For this reason, the various optional grain refiners are added to the copper-silicon alloys to provide this grain size control.

EXAMPLE IV

The ability of the reversible phase transformation from FCC alpha to HCP kappa (the superelastic response) to be repeated was tested by repeatedly cycling the alloys of Example III. The results of the cycling experiment are shown in Table IV for the first cycle and the tenth cycle.

TABLE IV

| Comparison Of Total Strain Under Cyclic Loading With Strain Remaining After Load Is Removed For Each Cycle | | | |
|---|---|---|---|
| Alloy, Annealing Temperature | Cycle No. | Strain Under Load, % | Strain Load Removed, % |
| X, 575° C | 1 | 0.75 | 0.71 |
| | 10 | 0.81 | 0.76 |
| H, 575° C | 1 | 0.50 | 0.37 |
| | 10 | 0.58 | 0.35 |

As can be seen from the results of Table IV, cycling does not impair the superelastic response of the alloy containing 4.80% Si. This response was found to be true for metal tested in both the annealing and cold worked condition.

EXAMPLE V

Tensile properties of Cu-Si based alloys of the superelastic composition contemplated by the instant invention were obtained after a 35% cold rolling reduction performed on alloy specimens after a 575° C anneal with and without a final low temperature anneal. For the ternary composition (Alloy G), tensile properties were also measured for alloys subjected to cold rolling after an 850° C solution anneal with and without a subsequent aging treatment. These tensile properties are shown in Table V. The low temperature thermal treatment of process B was performed at 200° to 350° C for 15 minutes to 24 hours.

TABLE V

| Tensile Properties Of Superelastic Alloys UTS, ksi/0.2% YS, ksi/% E* | | | | |
|---|---|---|---|---|
| | Process** | | | |
| Alloy | A | B | C | D |
| D | 111/71/– | | | |
| G | 126/81/4 | 130/90/3 | 117/78/4 | 122/88/1.5 |

*UTS = Ultimate tensile strength, 0.2% YS = 0.2% offset yield strength, E = Elongation
**A = 575° C + 35% cold rolled
B = A + low temperature thermal treatment
C = 850° C + 35% cold rolled
D = 850° C + aging treatment + 35% cold rolled The data presented in Table V indicates that the grain refined composition (Alloy G) has higher tensile properties than the binary copper-silicon alloy (Alloy D) after cold rolling. The grain refined composition is also capable of strength improvements by aging the alloy sample after solution treatment. In addition, it can be seen from Table V that a final low temperature thermal treatment of the alloy after cold rolling improves tensile properties.

EXAMPLE VI

Fatigue properties were measured for binary copper-silicon alloys containing percentages of silicon both within and without the range presented by the instant invention. Measurements were made of each alloy sample at equal yield strength levels and stress was applied to each sample to cause failure in $10^8$ cycles. These fatigue properties are shown in Table VI.

TABLE VI

| Fatigue Strength Comparison, Flexural Fatigue At Equivalent Yield Strength Levels | | |
|---|---|---|
| Alloy | 0.2% Yield Strength ksi | Stress to Cause Failure in $10^8$ Cycles, ksi |
| H | 69.0 | 36 |
| X | 70.0 | 25 |

These fatigue properties were made by completely reversed bending of each alloy sample. Each sample was cold rolled to obtain equivalent 0.2% yield strengths. Table VI indicates that the binary Cu-Si superelastic composition within the range of the instant invention has a clearly superior fatigue strength over the Cu-Si alloy with a silicon range below that required by the instant invention.

As demonstrated by the examples presented hereinabove, the copper-silicon based alloys of the present invention exhibit superelastic properties which enable these alloys to be used in applications which require a high fatigue strength. The alloys of the present invention can easily withstand bending stresses and related cycling stresses which would cause failure in prior art alloys utilized for the same purpose and even in copper-silicon alloys having silicon percentages outside of the silicon range of the alloy presented herein.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A wrought copper base alloy having high fatigue strength and improved elastic properties, said alloy consisting essentially of 4.4 to 5.2 weight percent silicon, 0.1 to 3.0 weight percent zinc, a combination of titanium, zirconium and chromium including titanium, zirconium and chromium, from 0.05 to a total for the three elements of 0.6 weight percent, 0.1 to 2.0 weight percent for a combination of cobalt and iron, balance copper.

2. An alloy according to claim 1 wherein 0.1 to 1.0 weight percent each of elements selected from the group consisting of aluminum, gallium, germanium and indium are substituted for the silicon, provided that not less than 4.4 weight percent silicon is present in the alloy.

3. A method of producing a wrought copper base alloy having high fatigue strength and improved elastic properties comprising casting a copper base alloy consisting essentially of 4.4 to 5.2 weight percent silicon, 0.1 to 3.0 weight percent zinc, a combination of titanium, zirconium and chromium including titanium, zirconium and chromium, from 0.05 to a total for the three elements of 0.6 weight percent, 0.1 to 2.0 weight percent for a combination of cobalt and iron, balance copper, hot rolling the cast alloy at 560° to 900° C, cold rolling the alloy and annealing the alloy at 500° to 900° C.

4. A method according to claim 3 wherein said alloy is cold rolled to a 30% reduction with silicon contents of the alloy up to about 5.2 weight percent and to a 40–50% reduction with silicon contents of the alloy of 4.4–4.9 weight percent.

5. A method according to claim 3 wherein said cold rolling and annealing steps are performed in cycles to obtain the desired final gage of the wrought alloy.

6. A method according to claim 5 wherein the last anneal is at 500° to 760° C.

7. A method according to claim 3 wherein said alloy is additionally subjected to a low temperature thermal treatment at 200° to 350° C for 15 minutes to 24 hours.

8. A method according to claim 3 wherein the cast alloy is homogenized at 650° to 900° C either before or after hot rolling.

9. An alloy produced according to the process of claim 3.

* * * * *